United States Patent [19]

Kaneko et al.

[11] Patent Number: 4,907,015

[45] Date of Patent: Mar. 6, 1990

[54] THERMAL PRINTING HEAD

[75] Inventors: Toshiki Kaneko; Yoshiaki Kita; Hisashi Andoh, all of Ibaraki; Kiyoshi Konno, Hyogo, all of Japan

[73] Assignee: Hitachi, Ltd., Tokyo, Japan

[21] Appl. No.: 235,530

[22] Filed: Aug. 24, 1988

[30] Foreign Application Priority Data

Aug. 26, 1987 [JP] Japan ..... 62-211632

[51] Int. Cl.[4] ..... E01D 15/10

[52] U.S. Cl. ..... 346/76 PH; 219/216

[58] Field of Search ..... 219/216 PH; 346/76 PH

[56] References Cited

FOREIGN PATENT DOCUMENTS 0021264 2/1985 Japan ..... 219/216 PH
0058877 4/1985 Japan .
0115462 6/1985 Japan .

*Primary Examiner*—B. A. Reynolds
*Assistant Examiner*—Huan H. Tran
*Attorney, Agent, or Firm*—Antonelli, Terry & Wands

[57] ABSTRACT

A thermal printing head in accordance with the present invention has a substrate formed of an electrical insulator, heating elements formed on the substrate, and conductive layers formed on the part of the heating elements that is adjacent to and on either side of heat generating portions of the heating elements. The resistivity of heating elements is set at a value of not less than 1000 μΩ.cm and, simultaneously, the thickness of conductive layers is set at a value of not more than 300 nm. By virtue of this arrangement, it is possible to reduce the distance between the heat generating portions of the head and the printing paper or ink sheet, and the thin conductive layers contribute to minimizing diffusion of the heat. The thermal printing head is therefore capable of efficiently and accurately transferring heat generated by the heat generating portions to the printing paper or ink sheet. The head is suitable for producing half-tone prints and is capable of producing highly gradated prints such as fully-colored prints.

21 Claims, 6 Drawing Sheets

THERMAL PRINTING HEAD

BACKGROUND OF THE INVENTION

1. Field of the Invention

The present invention relates to a thermal printing head and, more particularly, to a thermal printing head suitable for producing half-tone prints.

2. Prior Art

Printers employing a thermal transfer printing method are widely used as printing systems in office automation equipment such as facsimile machines and word processors or in producing hard copies of video images because printers of this type are inexpensive, they generate less noise during operation, and they can be made compact. In order to obtain good printed characters or images with a printer employing a thermal transfer printing method, the thermal printing head and the printing paper must be brought into close contact with each other so that the heat generated by the head is accurately transferred to the printing paper. For this purpose, Japanese Patent Laid-Open No. 159176/1981 discloses a conventional thermal printing head in which convex glazed layers are formed on the surface of a substrate, band-shaped heating elements are formed on the glazed layers, and conductive layers are provided adjacent to and on either side of heat generating portions of the heating elements. Thus, according to the above-mentioned disclosure, the heat generating portions of the thermal printing head are formed with a generally convex shape, thereby attaining good contact between the head and the printing paper or ink sheet.

The conductive layers provided on either side of the heat generating portion of the head are formed of thin films. These thin films, however, have a thickness of 1 to several μm. As a result, the heat generating portions are each positioned at the bottom of a valley portion formed between parts of a conductive layer, resulting in an increase in the distance between the heat generating portions of the thermal printing head and the printing paper. Accordingly, even when the temperature of the heat generating portions of the head was precisely controlled, it has been difficult to achieve an image quality properly reflecting that temperature control. In addition, since the conductive layers provided on either side of the heat generating portions usually have good thermal conductivity, the heat of the heat generating portions may also be transferred to the conductive layers. At such a time, the printing paper may be heated over an area wider than the dimensions of the heat generating portions, resulting in the printing of dots with a low density. The heat generating portions interposed between the parts of the conductive layers also raise a problem in which they tend to trap fine particles of paper.

SUMMARY OF THE INVENTION

An object of the present invention is to eliminate the above-stated problems of the prior art and to provide a thermal printing head which is capable of ensuring good contact between the heat generating portions of the head and the printing paper or ink sheet, thereby enabling heat generated by the heat generating portions to be transferred accurately to the printing paper or ink sheet.

To this end, according to the present invention, there is provided a thermal printing head comprising a substrate formed of an electrical insulator, heating elements formed on the substrate, conductive layers each formed on the part of the surface of each of the heating elements that is adjacent to and on either side of a heat generating portion of the heating element, and protective layers each formed on the surfaces of each of the conductive layers and the heat generating portion of each of the heat generating elements, the resistivity of the heating elements being not less than 10000 μΩ·cm, and the thickness of the conductive layers at least in the vicinity of the heat generating portion of the thermal printing head being not more than 300 nm.

According to the present invention, since the heating elements of the thermal printing head are formed of a material having a high resistivity of not less than 10000 μΩ·cm, it is possible to reduce the thickness of the conductive layers, thereby enabling a higher level of contact between the head and the ink sheet. The resistivity of the heating elements of the thermal printing head in accordance with the present invention is at least N times of that of conventional resistors. If the calorific value of the heating elements is expressed as the product $(\text{current})^2 \times$ resistance, and simultaneously if the calorific value required of the heating elements is the same as that obtained with conventional resistors, the current flowing through a circuit of the thermal printing head can be about $1/\sqrt{N}$ or less of what has conventionally been necessary.

Accordingly, the calorific value that is attributable to the action of the conductive layers, which act to supply electricity to the heating elements, can be about 1/N or less of a corresponding value which has conventionally been necessary. Therefore, if the calorific value of the conductive layers is to be the same as that obtained with the conventional arrangement, it is possible to reduce the thickness of the conductive layers to a level which is about 1/N or less of the conventionally required thickness.

If the resistivity is less than 10000 μΩ·cm, it is impossible to attain a sufficiently large decrease in the circuit current, and it is therefore impossible to attain a sufficient reduction in the thickness of the conductive layers.

The above-described arrangement can be discussed as follows. The energy applied is consumed by the heat generating portions and the IR drop caused by the wiring resistance. Therefore, in order to achieve efficient printing, it is desired that consumption by the wiring resistance should be as low as possible relative to that by the heating elements. If the resistance of resistors constituting the heating elements and corresponding to the dots is large, such a large resistance can prevent the printing efficiency from being affected by the energy consumption by the wiring resistance even if this resistance is considerably large. Meanwhile, a sufficiently large resistivity of the heating elements allows a reduction in the thickness of the conductive layers at the electrode portions, thereby enhancing the level of contact between the head and the ink sheet.

Further, according to the present invention, the thickness of the conductive layers in the vicinity of the heat generating portions of the thermal printing head is set to a value of not more than 300 nm. This arrangement enables a reduction in the size of the gap between the heat generating portions and the printing paper or ink sheet, and this arrangement also minimizes diffusion of the heat generated by the heating elements through the conductive layers in the lateral direction thereof.

If the thickness of the conductive layers in the vicinity of the heat generating portions exceeds 300 nm, it is impossible to attain a sufficient reduction in the size of the gap between the heat generating portions and the surface of the printing paper or ink sheet. Further, such an undesirable thickness leads to an increase in the amount of heat that is generated by the heating elements and that diffuses through the conductive layers in the lateral direction thereof.

The thickness of the conductive layers should preferably be within the range from 30 to 300 nm. If these layers are thinner than 30 nm, the resistance of the conductive layers increases, thereby hindering the application of energy to the heating elements.

Thus, with the arrangement of the present invention, the resistivity of the heating elements is set to a value of not less than 10000 $\mu\Omega$·cm, and the thickness of the conductive layers in the vicinity of the heat generating portions is set at a value of not more than 300 nm, thereby attaining a reduction in the distance between the heat generating portions and the printing paper or ink sheet, and also attaining a reduction in the diffusion of heat in the lateral direction of the conductive layers. Thus, the thermal printing head of the present invention has a flattened configuration in the vicinity of the heat generating portion, thereby attaining good contact with the printing paper or ink sheet so that the heat generated by the heating elements can be efficiently and accurately transferred to the printing paper or ink sheet. The thermal printing head may be a head suitable for producing half-tone prints, and, in this case, the thermal printing head is capable of producing fully-colored prints which are highly gradated.

BRIEF DESCRIPTION OF THE DRAWINGS

FIG. 4 (*b*) is a view of an example of a print produced by the thermal printing head shown in FIG. 4 (*a*);

FIG. 5 (*b*) is a view of an example of a print produced by the conventional thermal printing head shown in FIG. 5 (*a*);

DESCRIPTION OF THE PREFERRED EMBODIMENTS

Certain embodiments of the present invention will be described with reference to FIGS. 1 to 8.

Figure 1:
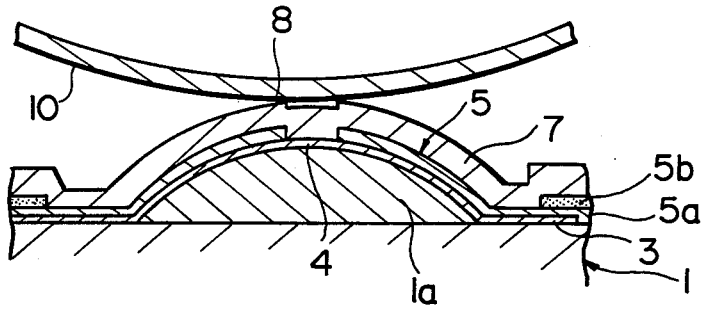
FIG. 1 is a sectional view showing a thermal printing head in accordance with one embodiment of the present invention.

FIG. 1 illustrates a thermal printing head in accordance with one embodiment of the present invention.

A substrate 1 of the head has, on the surface thereof, a glazed layer 1*a* which may be flat or convex. Heating elements 3 are formed over the surface of the substrate 1, using a thin film. The heating elements 3 consist of resistors which are formed of a composite of an intermetallic compound and an electrically insulating material, a boride, a carbide, a nitride, or a semiconductor, and which have a resistivity of not less than 10000 $\mu\Omega$·cm.

A composite of an intermetallic compound and an electrically insulating material which may be used for forming the resistors contains an electrically insulating material 3 to 20 vol %, and the composite is formed by a suitable method such as sputtering in which particles of the compound and the material are strongly bonded on the interface in the form of solid solutions or by means of reactions.

Intermetallic compounds which may be used include silicides of Nb, Ta, V, W, Cr, Mo, and Ti, e.g., $Nb_5Si_3$, $NbSi_2$, $Ta_2Si$, $Ta_5Si_3$, $TaSi_2$, $V_3Si$, $V_5Si_3$, $VSi_2$, $W_5Si_3$, $WSi_2$, $Cr_3Si$, $Cr_5Si_3$, CrSi, $CrSi_2$, $Mo_3Si$, $Mo_3Si_2$, $MoSi_2$, $Ti_5Si_3$, TiSi, and $TiSi_2$. Also usable are aluminum compounds of Co, Zr, Ta, Ti, and Ni, e.g., $Ni_3Al$, NiAl, $Ni_2Al_3$, CoAl, $Co_2Al_3$, TiAl, ZrAl, $ZrAl_2$, $TaAl_2$, and $TiAl_3$.

A material which may be used as an electrically insulating material is a material having a resistivity of not less than $1\times10^9$ $\mu\Omega$·cm; preferable examples are, for instance, $SiO_2$, $Al_2O_3$, $Ta_2O_3$, $ZrO_2$, $Y_2O_3$, and $Si_3N_4$.

Preferable examples of borides include borides such as HfB, VB, MoB, LaB, TaB, TiB, CoB, NbB, and WB of which the resistivity has been adjusted to be not less than 10000 $\mu\Omega$·cm by adding oxygen to the borides. Suitable examples of carbides include SiC and $Al_4C_3$. Suitable examples of nitride include: TaN; and $Si_3N_4$, AlN, and BN which are substantial insulators and of which the resistivity has been adjusted to be not less than 10000 $\mu\Omega$·cm by changing the atomic ratio to form a film. Suitable examples of semiconductors include B or As doped Si, etc.

The followings are some of prior art publications bearing descriptions about materials for heating elements: Japanese Patent Laid-Open No. 53459/1983, Japanese Patent Laid-Open No. 115462/1985, Japanese Patent Laid-Open No. 122884/1983, and Japanese Patent Laid-Open No. 49860/1986.

Japanese Pat. No. 53459/1983 proposes a double-layer structure consisting of a Cr layer and a Si layer. According to this proposal, however, heating elements have a resistivity of not more than 10000 $\mu\Omega$·cm, and they cannot be used in the present invention. Japanese Patent Laid-Open No. 122884/1983 and Japanese Patent Laid-Open No. 49860/1986 propose the use of Cr-Si-O-N and Ti-Si-O, respectively. According to either proposal, however, heating elements have a resistivity of not more than 5000 $\mu\Omega$·cm, and they cannot be adopted in the present invention.

Japanese Patent Laid-Open No. 115462/1985 proposes heating elements formed of films of a Ta-Ni-$SiO_2$ mixture, and they may be adopted in the present invention. However, it should be noted that this publication gives no description concerning the reduction of the thickness of conductive layers.

First conductive layers 5a are formed, using a film, on the heating elements 3 that are formed by the above-described resistors. The first conductive layers 5a are formed in such a manner as to be adjacent to and on either side of heat generating portions 4 of the heating elements 3. The thermal printing head is brought into contact with an ink sheet 10 at a region 8 thereof which includes the heat generating portions 4, so that characters or images are printed on the sheet by transfer of heat. According to the present invention, the thickness of the first conductive layers 5a is set at a value of not more than 300 nm over a region which is wider than the region 8 at which the thermal printing head is brought into contact with the printing paper. That part of the first conductive layers 5a within this particular region is preferably formed by using a metal such as chromium, nickel, copper, silver, gold or platinum, or a nickel-copper alloy, which ensures that, even when the heating elements 3 generate heat, the conductive layers 5a experience neither diffusion of the heat nor softening, and which provides an excellent adhesion with the heating elements 3. On the other hand, in a region where the thermal printing head is not brought into contact with the printing paper, it is preferred that second conductive layers 5b which have a relatively large thickness are provided. The second conductive layers 5b may either be formed of a material of the same type as that used to form the first conductive layers 5a in the contact region 8 or be formed as a laminate body comprising different materials. The second conductive layers 5b should preferably have a thickness on the order of 1 to 5μ m and have a resistivity as low as possible.

The configuration of the heating elements varies depending on the printing method used. When multi-gradation prints are to be obtained by a dye-sublimation process, it is preferred that heating elements of a straight shape are used, and the amount by which the dye is sublimated is controlled through control over the input power to vary the density. On the other hand, when a wax-type pigment melting transfer process is used, it is preferred that heating elements having a complicated shape are used. For instance, the width of the heating elements 3 is partially narrowed so that current concentrates on certain portions of the heating elements. Using such heating elements 3, the area over which heat is generated is controlled through control over the input power to vary the the size of dots to be printed and, hence, to vary the density. A prior art publication which gives descriptions about the width of the heating elements is, for instance, Japanese Patent Laid-Open No. 58877/1985. This publication proposes to make the width of heating elements higher and narrower toward the central portion between the electrodes.

The thermal printing head of the present invention also comprises film-formed protective layers 7 which are wear resistant. After the formation of the layers 7, for the purpose of flattening as much as possible the part of the layers 7 that is immediately above the heat generating portions 4, the protective layers 7 should preferably be subjected to a flattening process such as dry etching.

Fine control over the density and, hence, production of multi-gradation prints are made possible by controlling the energy input to the heating elements 3 into multiple levels, and accurately transferring the thus controlled energy to the printing paper or ink sheet 10. According to the present invention, in order to accurately transfer the heat generated by the heating elements 3 to the printing paper or ink sheet 10, the thickness of the first conductive layers 5a is reduced over a region which is wider than the region 8 of contact between the thermal printing head and the printing paper or ink sheet 10, the thickness being reduced to a value which is much smaller than a conventionally adopted thickness and which is not more than 300 nm. The size of the contact region 8 varies in accordance with the pressure with which the head presses against the ink sheet 10; when the pressure is large, the region 8 is wide, whereas, when the pressure is small, the region 8 is narrow. By virtue of the above-described reduction of the thickness of the first conductive layers 5a, the configuration of the part of the thermal printing head that corresponds to the heat generating portions 4 is made less irregular, thereby ensuring good contact between the heat generating portions 4 of the head and the printing paper or ink sheet 10.

Such a reduction in the thickness of the first conductive layers 5a in the vicinity of the heat generating portions 4 enables a corresponding reduction in the distance between the heating elements 3 and the printing paper or ink sheet 10 if the thickness of the protective layers 7 is the same. The reduction in the thickness of the layers 5a provides another advantage in that transfer of the heat through the first conductive layers 5a in the lateral direction thereof is minimized, thereby enabling efficient printing. In addition, the following effect is provided. With a conventional printing head in which first conductive layers are thick in the vicinity of the heat generating portions 4, the heat may diffuse around various peripheral portions through the first conductive layers which are also good thermal conductors, resulting in the printing of dots each having a diameter larger than desired. In contrast, according to the present invention, by virtue of the reduction of the thickness of the first conductive layers 5a, which may act as the passage through which the heat diffuses, to a very small thickness of 300 nm, the diffusion of the heat in the lateral direction is minimized, thereby reducing the diameter of one dot. This feature of the head of the present invention improves qualities of prints where the density is low, thereby enabling the production of prints which are more highly gradated with a greater number of levels, more specifically, with at least 32 gradation levels.

As described above, the print qualities can be enhanced by reducing the thickness of the conductive layers 5a in the vicinity of the heat generating portion 4 to a thickness of not more than 300 nm. In order to achieve the object of the present invention, however, it is also necessary to reduce the current flowing through a circuit in the thermal printing head because the reduction in the thickness of the conductive layers 5a can cause an increase in the wiring resistance which increase may, in turn, cause generation of heat within the conductive layers 5a, and such generation of heat has to be prevented. This requirement is effectively met by increasing the resistivity of the heating elements 3 of the thermal printing head to a value of not less than 1000 μΩ·cm. Since the calorific value of the heating elements 3 can be expressed as $I^2R$ (where I represents the circuit current and R represents the resistance of the heating elements 3), if the calorific value required of the heating elements 3 is the same, in order to enable a reduction in the thickness of the conductive layers 5a to a level of 1/N of an unreduced thickness, the circuit current must be reduced to a level of $1/\sqrt{N}$ of a corresponding level before the thickness reduction. The reduction in the circuit current can be achieved by adopting a resistivity of the heating elements 3 which is N times of a conventionally adopted value. In general, the resistivity of heating elements of a thermal printing head which are currently put into practice is usually on the order of 2000 μΩ·cm. With a resistivity of not less than 10000 μΩ·cm, which is at least 5 times of a currently used value, the thickness of films forming the conductive layers 5a and the wiring can be reduced to a level which is 1/5 or less of what is currently adopted, with the thickness of the film forming the heating elements 3 remaining the same. Since the currently adopted thickness of a film forming the conductive layers 5a or the wiring is usually on the order of 1.5μ m, if the heating elements 3 having a resistivity of not less than 10000 μΩ·cm are used, the thickness being discussed can be reduced to a value of not more than 300 nm.

If the conductive layers 5a and the wiring are formed using a single thin film, it suffice to pattern, by photo-etching, a film for forming single-film conductive layers 5 as well as the wiring, thereby reducing the number of manufacturing processes required, to a great extent.

In this way, with a thickness of the film forming the conductive layers 5 is set at a value of not more than 300 nm, the configuration of the head in the vicinity of the heat generating portions 4 is very close to a flat one. However, an irregularity which corresponds to the thickness and which is at most about 300 nm remains. In order to achieve good contact between the head and the ink sheet or printing paper, the irregularity should preferably be not more than 100 nm. For this purpose, it is preferred that, after the formation of the films of the protective layers 7, these layers 7 are subjected to a suitable process, such as dry etching, thereby substantially completely eliminating the remaining irregularity.

Figure 2:
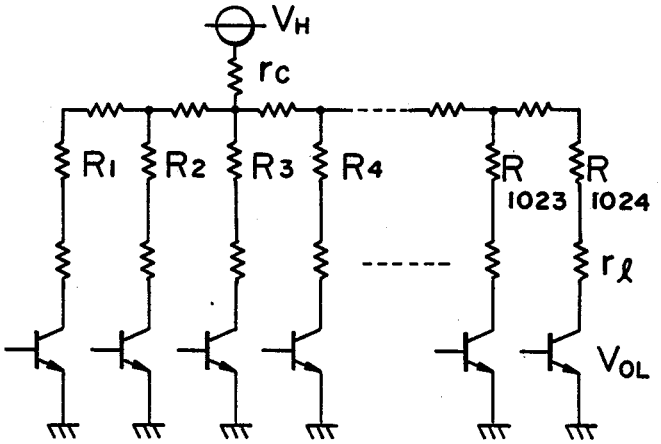
FIG. 2 is a circuit diagram showing a circuit equivalent to a circuit of the thermal printing head.
Figure 3:
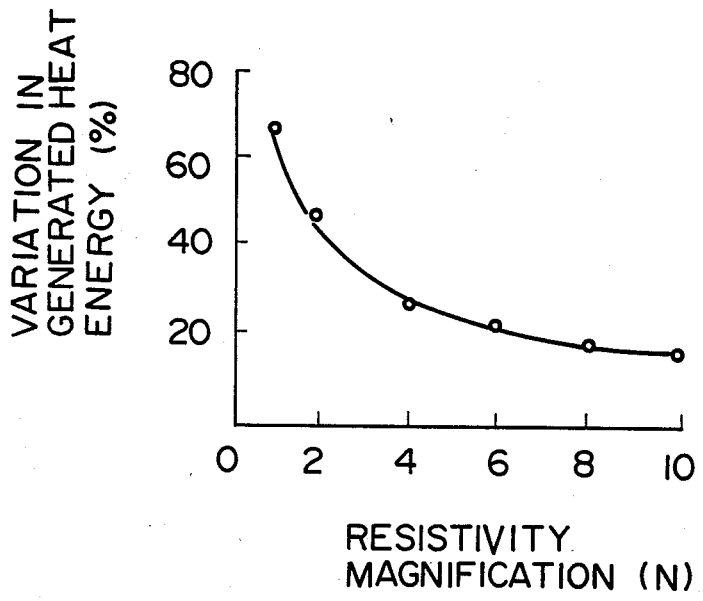
FIG. 3 is a graph showing an effect provided by virtue of a high resistivity of heating elements used in the head of the present invention.

The adoption of an increased resistivity of the heating elements 3 also makes it possible to reduce the variation in density between the case where a large number of dots are printed and the case where a small number of dots are printed, with the same level of energy being applied each time. One advantage provided as a result of the above-described reduction in variation will be explained with reference to FIGS. 2 and 3. For instance, it is assumed that, in a circuit equivalent to the circuit of the thermal printing head as illustrated in FIG. 2, the resistance of heat generating resistors $R_1$ to $R_{1024}$, corresponding to dots, is magnified by a factor N, for instance, from 1 kΩ to NkΩ. In this case, the variation in the heat generation among various cases where 1 dot to 1024 dots are to be printed can be reduced to a great extent compared to the case where the resistance remains 1 KΩ, as shown in FIG. 3.

More specifically, the thermal printing head has a structure in which more than 1000 resistors are connected in parallel. The combined resistance of these resistors varies in accordance with the number of dots to be printed. For instance, when only one dot is to be printed, the combined resistance is R1, whereas, when 1024 dots are to be printed, the combined resistance drops to the very small value of R1/1024. While the combined resistance thus varies, the common electrode resistance (expressed as "rc" in FIG. 2) remains constant. When the combined resistance is large, influence by the common electrode resistance is negligible. However, when the combined resistance is small, the influence of the common electrode resistance is not negligible because a large part of the energy to be applied to the heat generating portions is consumed by the common electrode, thereby decreasing the energy applied to the heat generating portions. In consequence, the density of the resulting print is lower than that of a print in which a small number of dots are printed. The above-described variation in density can be reduced effectively by increasing the resistance of the dot-corresponding resistors $R_1$ to $R_{1024}$, as shown in FIG. 3.

Next, certain examples of processes for manufacturing thermal printing heads in accordance with the present invention will be illustrated below.

EXAMPLE 1

A thermal printing head having the same film structure as that shown in FIG. 1 is manufactured in the following manner. First, on the surface of a substrate 1 provided with convex glazed layers 1a, a film which is to serve as heating elements 3 is formed by a sputtering method, the heating elements 3 comprising a composite of 90 to 95% $CrSi_2$ used as an intermetallic compound, and 5 to 10% $SiO_2$ used as an electrically insulating material. The compound $CrSi_2$ and the material $SiO_2$ may either be sputtered from separate targets and thus by a two-target simultaneous sputtering, or be sputtered from a common target. The resistivity $\rho$ of the thus formed thin-film resistors is on the order of 15000 μΩ·cm. A film of chromium which is to serve as the first conductive layers 5a is formed on the heating elements 3 by a sputtering method through a thickness of 150 nm. Further, aluminum is sputtered through a thickness of 1.5 to 2 μm onto the part of the head that does not correspond to a contact region 8, thereby providing second conductive layers 5b as relatively thick wiring layers. The second conductive layers 5b are patterned by photo-etching in such a manner that the intervals between two adjacent layers 5b are 1.5 mm, thereby minimizing the size of the gap between the heating elements 3 and printing paper or ink sheet 10 in the contact region 8 of the head, and also preventing heat from diffusing through the conductive layers 5 around an area wider than a desired dot area. The convex glazed layers 1a have a width of 1 mm.

Figure 4:
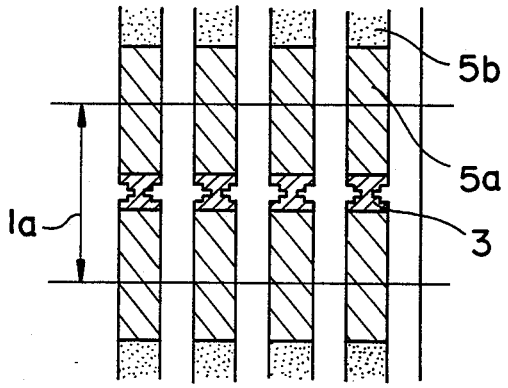
FIG. 4 (*a*) is a front view of a printing surface of the thermal printing head of the present invention.
Figure 4:
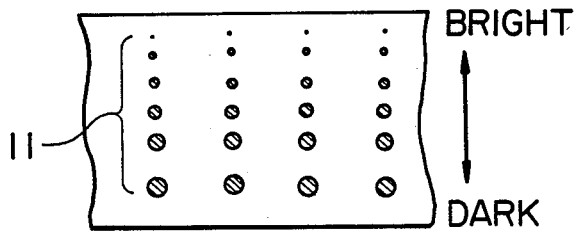

Subsequently, the first conductive layers 5a, which have a thickness of 150 nm and which extend to heat generating portions 4, are subjected to photo-etching in a similar manner. Thereafter, the heating elements 3 are subjected to a process in which their width is partially narrowed, thereby providing current concentration portions, as shown in FIG. 4 (*a*). Finally, films of $SiO_2$ and $Ta_2O_5$ which are to serve as protective layers 7 are formed through thicknesses of 2 μm and 1 μm, respectively.

In the thus manufactured thermal printing head, the configuration of the head in the vicinity of the heat generating portions 4 is flattened to a considerable extent, the distance between the heating elements 3 and the printing paper or ink sheet 10 is small, and the thickness of the conductive layers 5, which may act as a passage through the heat diffuses, is small and is not more than 300 nm in the vicinity of the heat generating portions 4. Therefore, with the head, diffusion of the heat can be minimized, and the heat generated by the heating elements 3 can be efficiently and accurately transferred to the printing paper or ink sheet 10. If, as shown in FIG. 4 (*a*), the width of the heating elements is partially narrowed, the configuration of dots 11 to be printed can be controlled through control over the input power, as shown in FIG. 4 (*b*). In particular, when small power is input, the head is capable of accurately printing fine dots. This feature of the head is advantageous in that prints with relatively low density can be accurately printed, thereby enabling fully-colored prints to be highly gradated.

Figure 5:
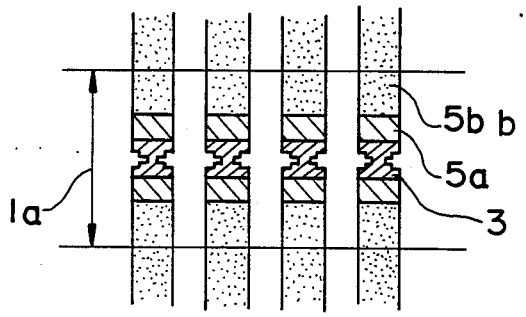
FIG. 5 (*a*) is a front view of a printing surface of a conventional thermal printing head, illustrated as a comparison.
Figure 5:
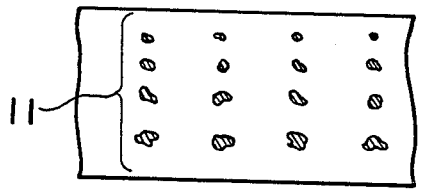

To provide a comparison comparable with Example 1, FIG. 5 shows examples of dots printed by a comparison thermal printing head which has resistors of a complicated shape similar to that shown in FIG. 4 (*a*) and which has first conductive layers with a thickness of 1.5 μm. Since the first conductive layers are thick, the configuration of the thermal printing head in its contact region 8 is tremendously irregular, this being the same as the case of the conventional thermal printing head described before. Because the distance between the heating elements and the printing paper or ink sheet 10 is great and because the heat is transferred also through the conductive layers, large power is required for printing dots, and it is difficult to print relatively small dots, while relatively large printed dots tend to be elongated toward the electrodes, the dots having irregular configurations, as shown in FIG. 5 (*b*). Therefore, the comparison head which produces such dots is not capable of providing highly gradated prints, and with the head, it is impossible to obtain good half-tone prints.

EXAMPLE 2

Figure 6:
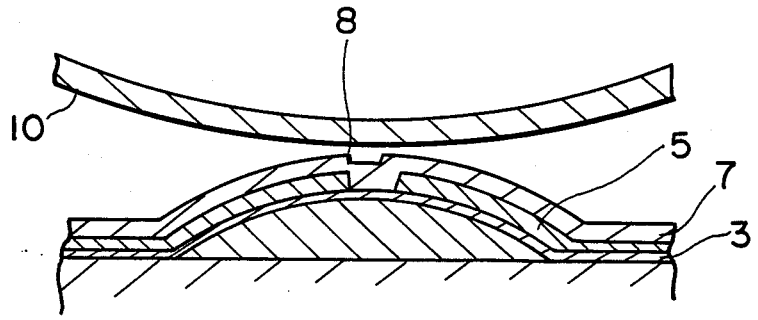
FIG. 6 is a sectional view of a thermal printing head in accordance with the present invention, the head having conductive layers which are formed using a single film and which have a thickness of not more than 300 nm throughout the surface of the head.
Figure 7:
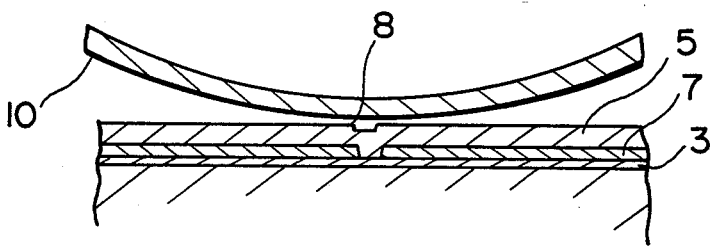
FIG. 7 is a sectional view of a thermal printing head in accordance with the present invention, the head having a flat shape and having conductive layers which are formed using a single film and which have a thickness of not more than 300 nm throughout the surface of the head.

FIGS. 6 and 7 each illustrate a thermal printing head having conductive layers 5 which are formed using a single film and which have a thickness of not more than 300 nm throughout the surface of the head except at the contact region 8. Suitable materials which may be used to form the conductive layers 5 include chromium, nickel, copper, silver, gold, platinum, and a nickel-copper alloy. Since the conductive layers are formed using a single film, manufacturing processes can be simplified to a great extent, thereby enabling a reduction in costs. If integrated circuit elements are to be connected to the substrate, the thickness of the conductive layers is made not more than 300 nm where these circuit elements are not connected.

EXAMPLE 3

Figures 8A, 8B, 8C:
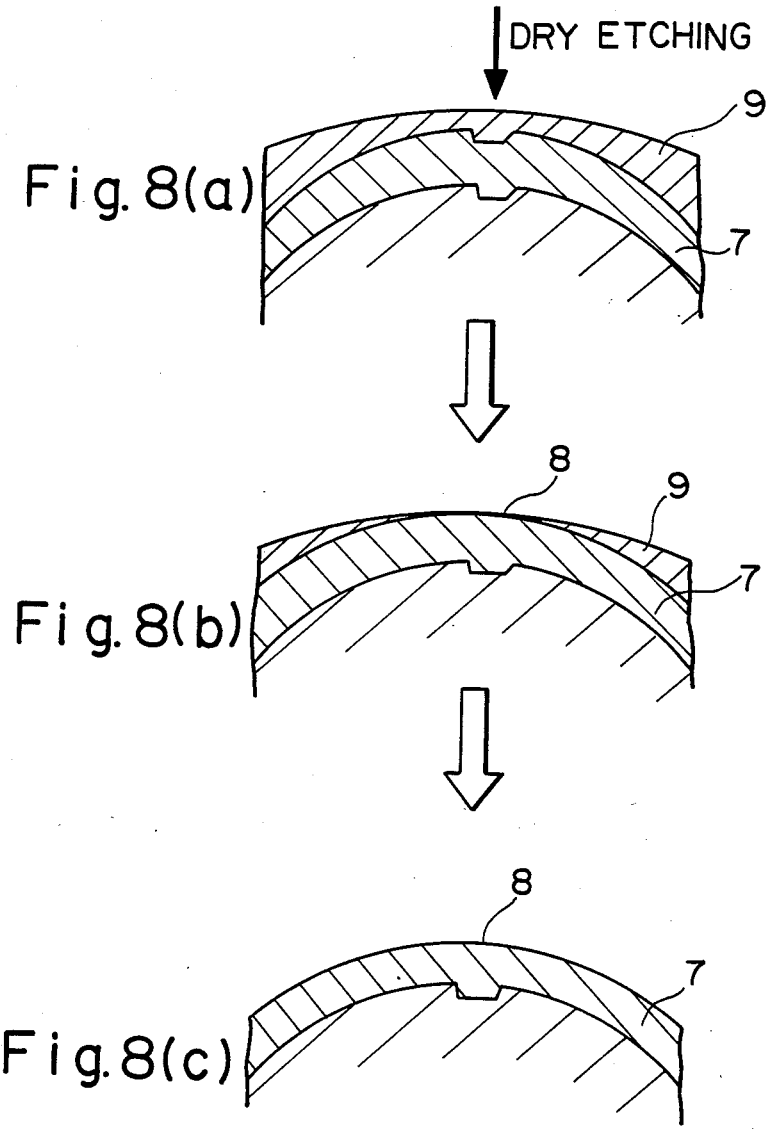
FIGS. 8 (*a*) to (*c*) are sectional views illustrating processes of flattening protective layers of the thermal printing head in accordance with the present invention.

Irregularity remaining in the surface of the protective layers 7 formed on the outermost side of a thermal printing head of the present invention can be eliminated by, for instance, dry etching. An example of a process performed for this purpose is shown n FIG. 8. After the formation of the protective layers 7, a resist 9 is coated on the surface of the head by spin coating in which a resist material is dripped and the head is rotated, as shown in FIG. 8 (*a*). Thereafter, dry etching is effected from above the resist 9, and when irregularity in the surface portion of the protective layers 7 that is immediately above the contact region 8 has been eliminated, as shown in FIG. 8 (*b*), the etching is terminated. The resist 9 is then removed, thereby obtaining the protective layers 7 having a configuration as shown in FIG. 8 (*c*). By the above-described processes, the irregularity in the surface of the protective layers 7 is eliminated, thereby substantially completely flattening the contact region 8 at the uppermost portion of the head. In the illustrated processes, a gas selected for the etching process should be such that it ensures the same etching rates with respect to the resist 9 and the protective layers 7. Alternatively, bias sputtering may be effected to form protective layers which are less irregular and substantially flat.

What is claimed is:

1. A thermal printing head comprising: a substrate formed of an electrical insulator; heating elements formed on said substrate; conductive layers each formed on the part of the surface of each of said heating elements that is adjacent to and on either side of a heat generating portion of the heating element; and protective layers each formed on the surfaces of each of said conductive layers and said heat generating portion of each of said heat generating elements, the resistivity of said heating elements being not less than 10000 μΩ·cm, and the thickness of said conductive layers at least in the vicinity of the heat generating portions of said thermal printing head being not more than 300 nm.

2. A thermal printing head according to claim 1, wherein the thickness of said conductive layers is not more than 300 nm throughout the surface of said thermal printing head.

3. A thermal printing head according to claim 1, wherein the thickness of said conductive layers is not more than 300 nm at portions of said substrate which are not portions of said substrate where integrated circuit elements are connected to said substrate.

4. A thermal printing head according to claim 1, wherein irregularity in the part of the surface of said protective layers that is immediately above said heat generating portions is not more than 100 nm.

5. A thermal printing head according to claim 1, wherein the thickness of said conductive layers is 30 to 300 nm.

6. A thermal printing head comprising: a substrate formed of an electrical insulator; heating elements formed on said substrate; conductive layers each formed on the part of the surface of each of said heating elements that is adjacent to and on either side of a heat generating portion of the heating element; and protective layers each formed on the surfaces of each of said conductive layers and said heat generating portion of each of said heat generating elements, the heating elements comprising a composite of an intermetallic compound and an electrically insulating material, the resistivity of said heating elements being not less than 10000 μΩ·cm, and the thickness of said conductive layers at least in the vicinity of the heat generating portions of said thermal printing head being not more than 300 nm.

7. A thermal printing head according to claim 6, wherein the thickness of said conductive layers is not more than 300 nm throughout the surface of said thermal printing head.

8. A thermal printing head according to claim 6, wherein the thickness of said conductive layers is not more than 300 nm at portions of said substrate which are not portions of said substrate where integrated circuit elements are connected to said substrate.

9. A thermal printing head according to claim 6, wherein irregularity in the part of the surface of said protective layers that is immediately above said heat generating portions is not more than 100 nm.

10. A thermal printing head according to claim 6, wherein said intermetallic compound is at least one selected from the group consisting of $Nb_5Si_3$, $NbSi_2$, $Ta_2Si$, $Ta_5Si_3$, $TaSi_2$, $V_3Si$, $V_5Si_3$, $VSi_2$, $W_5Si_3$, $WSi_2$, $Cr_3Si$, CrSi, $CrSi_2$, $Mo_3Si$, $Mo_3Si_2$, $Ti_5Si_3$, TiSi, $TiSi_2$, $Ni_3Al$, NiAl, $Ni_2Al_3$, CoAl, $Co_2Al_3$, TiAl, ZrAl, $ArAl_2$, $TaAl_2$ and $TiAl_3$ and said electrically insulating material is at least one selected from the group consisting of $SiO_2$, $Al_2O_3$, $Ta_2O_3$, $ZrO_2$, $Y_2O_3$, $Si_3N_4$, HfB, VB, MoB, LaB, TaB, TiB, CoB, NbB, WB, SiC, $Al_4C_3$, TaN, $Si_3N_4$, AlN and BN.

11. A thermal printing head comprising: a substrate formed of an electrical insulator; heating elements formed on said substrate; conductive layers each formed on the part of the surface of each of said heating elements that is adjacent to and on either side of a heat generating portion of the heating element; and protective layers each formed on the surfaces of each of said conductive layers and said heat generating portion of each of said heat generating elements, the resistivity of said heating elements being not less than 1000 $\mu\Omega$·cm, and the thickness of said conductive layers at least in the vicinity of the heat generating portions of said thermal printing head being not more than 300 nm, the width of said heating elements being narrowed at said heat generating portions thereof.

12. A thermal printing head according to claim 11, wherein the thickness of said conductive layers is not more than 300 nm throughout the surface of said thermal printing head.

13. A thermal printing head according to claim 11, wherein the thickness of said conductive layers is not more than 300 nm at portions of said substrate which are not portions of said substrate where integrated circuit elements are connected to said substrate.

14. A thermal printing head according to claim 11, wherein irregularity in the part of the surface of said protective layers that is immediately above said heat generating portions is not more than 100 nm.

15. A thermal printing head comprising: a substrate formed of an electrical insulator; heating elements formed on said substrate; conductive layers each formed on the part of the surface of each of said heating elements that is adjacent to and on either side of a heat generating portion of the heating element; and protective layers each formed on the surfaces of each of said conductive layers and said heat generating portion of each of said heat generating elements, the heating elements comprising a composite of an intermetallic compound and an electrically insulating material, the resistivity of said heating elements being not less than 10000 $\mu\Omega$·cm, and the thickness of said conductive layers at least in the vicinity of the heat generating portions of said thermal printing head being not more than 300 nm.

the width of said heating elements being narrowed at said heat generating portions thereof.

16. A thermal printing head according to claim 15, wherein the thickness of said conductive layers is not more than 300 nm throughout the surface of said thermal printing head.

17. A thermal printing head according to claim 15, wherein the thickness of said conductive layers is not more than 300 nm at portions of said substrate which are not portions of said substrate where integrated circuit elements are connected to said substrate.

18. A thermal printing head according to claim 15, wherein irregularity in the part of the surface of said protective layers that is immediately above said heat generating portions is not more than 100 nm.

19. A thermal printing head according to claim 16, wherein irregularity in the part of the surface of said protective layers that is immediately above said heat generating portions is not more than 100 nm.

20. A thermal printing head according to claim 17, wherein irregularity in the part of the surface of said protective layers that is immediately above said heat generating portions is not more than 100 nm.

21. A thermal printing head comprising: a substrate formed of an electrical insulator; heating elements formed on said substrate; conductive layers each formed on the part of the surface of each of said heating elements that is adjacent to and on either side of a heat generating portion of the heating element; and protective layers each formed on the surfaces of each of said conductive layers and said heat generating portion of each of said heat generating elements, the heating elements comprising a composite of an intermetallic metallic compound which is at least one selected from the group consisting of $Nb_5Si_3$, $NbSi_2$, $Ta_2Si$, $Ta_5Si_3$, $TaSi_2$, $V_3Si$, $V_5Si_3$, $VSi_2$, $W_5Si_3$, $WSi_2$, $Cr_3Si$, $Cr_5Si_3$, CrSi, $CrSi_2$, $Mo_3Si$, $Mo_3Si_2$, $MoSi_2$, $Ti_5Si_3$, TiSi, $TiSi_2$, $Ni_3Al$, NiAl, $Ni_2Al_3$, CoAl, $Co_2Al_3$, TiAl, ZrAl, $ZrAl_2$, $TaAl_2$ and $TiAl_3$ and an electrically insulating material which is at least one selected from the group consisting of $SiO_2$, $Al_2O_3$, $Ta_2O_3$, $ZrO_2$, $Y_2O_3$, $Si_3N_4$, HfB, VB, MoB, LaB, TaB, TiB, CoB, NbB, WB, SiC, $Al_{44}C_3$, TaN, $Si_3N_4$, AlN and BN, the resistivity of said heating elements being not less than 10000 $\mu\Omega$cm, and the thickness of said conductive layers at least in the vicinity of the heat generating portions of said thermal printing head being not more than 200 nm, the width of said heating elements being narrowed at said heat generating portions thereof.

* * * * *